US006401357B1

(12) United States Patent
Smith et al.

(10) Patent No.: US 6,401,357 B1
(45) Date of Patent: Jun. 11, 2002

(54) END OF CYCLE DETECTOR AND METHOD FOR MICROWAVE CLOTHES DRYER

(75) Inventors: Richard D. Smith, Palo Alto; John F. Gerling; Stephen D. Schultz, both of Modesto, all of CA (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 09/593,720

(22) Filed: Jun. 13, 2000

(51) Int. Cl.[7] ..... F26B 3/34
(52) U.S. Cl. ..... 34/260; 219/707
(58) Field of Search ..... 34/260, 261; 219/707, 219/751; 340/825.22

(56) References Cited

U.S. PATENT DOCUMENTS 4,400,699 A * 8/1983 Glasmacher ..... 340/825.22
4,771,156 A * 9/1988 Strattan et al. ..... 219/757
4,795,871 A * 1/1989 Strattan et al. ..... 219/707
5,187,879 A * 2/1993 Holst ..... 34/261
5,270,509 A 12/1993 Gerling
5,315,765 A * 5/1994 Holst et al. ..... 34/260
5,321,897 A * 6/1994 Holst et al. ..... 34/260
5,396,715 A 3/1995 Smith
5,483,045 A 1/1996 Gerling
5,606,804 A 3/1997 Smith et al.
5,661,227 A 8/1997 Smith et al.

* cited by examiner

*Primary Examiner*—Teresa Walberg
*Assistant Examiner*—Leonid M Fastovsky
(74) *Attorney, Agent, or Firm*—Flehr Hohbach Test Albritton & Herbert LLP

(57) ABSTRACT

End of cycle detector and method for a microwave clothes dryer. The temperature of fabric in the dryer is monitored, an increase in the monitored temperature is detected when substantially all moisture has been removed from the fabric, and operation of the dryer is controlled in response to the increase in temperature.

11 Claims, 1 Drawing Sheet

END OF CYCLE DETECTOR AND METHOD FOR MICROWAVE CLOTHES DRYER

This invention pertains generally to microwave clothes dryers and, more particularly, to an end of cycle detector and method for a microwave clothes dryer.

Conventional tumble dryers use a variety of techniques for sensing fabric dryness to determine the end of a drying cycle. The most common utilizes a metallic device that makes direct contact with the tumbling fabric and monitors electrical resistance as an indication of the moisture content of the fabric. Another method is to measure the relative humidity of air in the exhaust vent, although the reliability of this method is limited whenever the ambient relative humidity is high.

These methods are less effective when utilized in microwave clothes dryers. This is especially true for the metallic contact sensor where arcing can occur between the sensor and metal objects such as buttons, buckles or zippers in the clothes.

It is in general an object of the invention to provide a new and improved end of cycle detector and method for a microwave clothes dryer.

Another object of the invention is to provide an end of cycle detector and method of the above character which overcome the limitations and disadvantages of the prior art.

These and other objects are achieved in accordance with the invention by providing an end of cycle detector and method in which the temperature of fabric in a microwave clothes dryer is monitored, an increase in the monitored temperature is detected when substantially all moisture has been removed from the fabric, and operation of the dryer is controlled in response to the increase in temperature.

Figure 1:
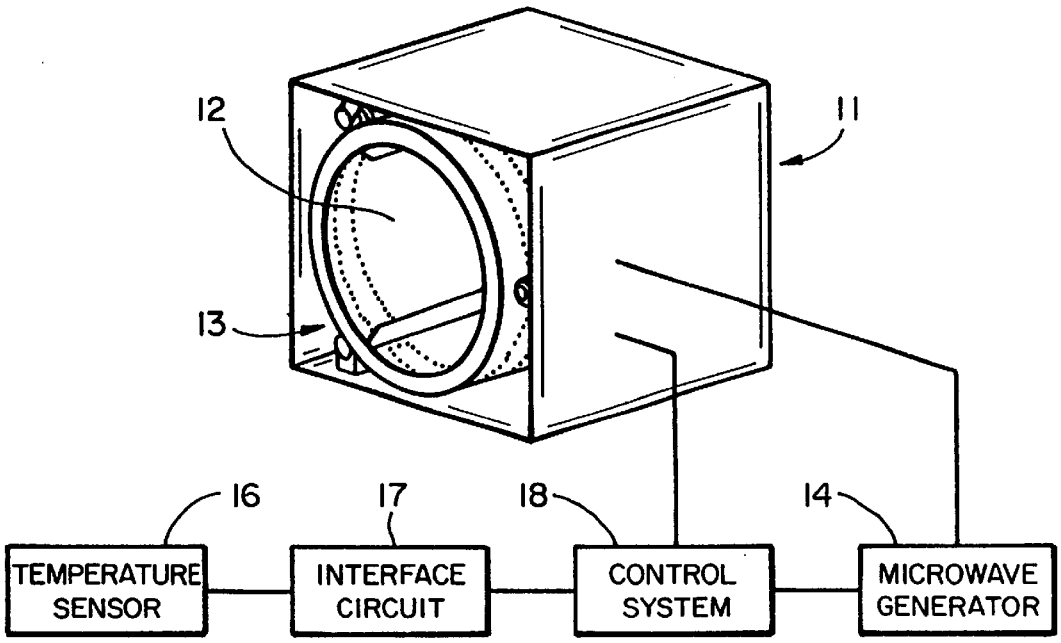
FIG. 1 is a schematic diagram of one embodiment of a microwave clothes dryer with an end of cycle detector incorporating the invention.

In the drawings, the invention is illustrated in connection with a microwave clothes dryer 11 which has a rotating basket 12 for tumbling clothes and/or other fabric articles in a drying chamber 13. The dryer includes a magnetron or microwave generator 14 for introducing microwave energy into the chamber to vaporize moisture in the tumbling fabric.

It has been found that in a microwave dryer, unlike conventional clothes dryers, the fabric remains relatively cool until most of the moisture has been removed and that there is a detectable rise in the temperature of the fabric at the end of the drying cycle. This relationship is shown graphically in FIG. 2, where fabric temperature (T) and moisture content are shown as a function of drying cycle time (t).

In contrast, conventional dryers using hot air to evaporate the moisture must heat the fabric and the moisture before vaporization can occur, and there is no useful relationship between moisture content and temperature. The temperature remains high throughout the drying cycle.

The invention uses the rise in temperature in a microwave dryer to detect the end of the drying cycle and to control the operation of the dryer accordingly, e.g. by shutting it down. For this purpose, a temperature sensor 16 provides an electrical signal corresponding to the temperature of the fabric in the drying chamber, and an interface circuit 17 processes the signal for use by a control system 18.

The temperature sensor can be either contacting or non-contacting. Suitable contacting devices include thermocouples, resistance temperature detectors, and fiber optic sensors. Suitable non-contacting devices include thermopile detectors and thermoelectric infrared sensors. The presently preferred sensor is a non-contacting infrared sensor which is located outside the drying chamber and monitors the infrared energy given off by the fabric through a viewing port comprising a waveguide beyond cut-off.

The interface circuitry derives or receives an electrical signal from the sensor, and converts that signal to a form which can be used by the control system. If desired, the temperature sensor and the interface can be combined in a single unit such as the Heimann Model TPMFϕ.

The control system controls the functional operation of the dryer and the drying process. It includes means for monitoring the signal from the interface circuit, detecting the rise in temperature which signifies the end of the drying cycle, and controls the operation of the dryer accordingly. One example of a suitable controller is the Z-World Model BL 1500 programmable controller.

Figure 2:
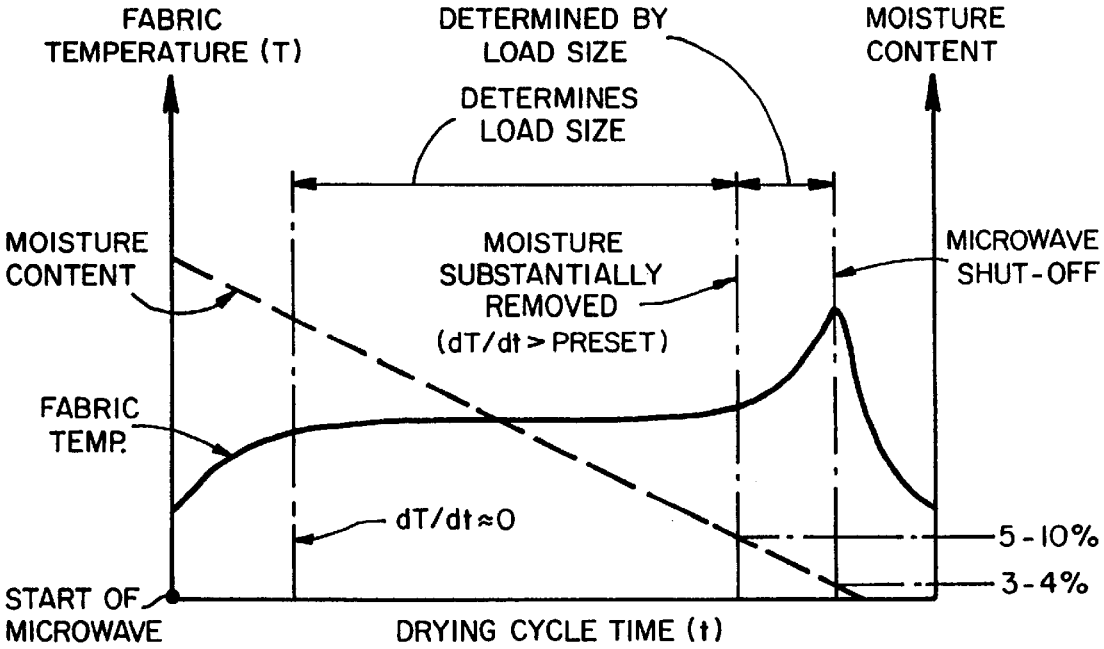
FIG. 2 is a graphical representation of the relationship between fabric temperature, moisture content and drying time in a microwave clothes dryer.

As illustrated in FIG. 2, in a microwave clothes dryer, the moisture content of the fabric decreases linearly as a function of the drying cycle time. The fabric temperature rises initially, then levels out so that $dT/dt \approx 0$ and remains substantially level until only about 5–10 percent of the moisture is left in the fabric. At that point, the temperature rises sharply, and dT/dt exceeds a predetermined level. A preset time after dT/dt reaches that level, the microwave generator is shut off. The length of that preset time is dependent upon the size of the load which is determine by the time interval between the points where $dT/dt \approx 0$ and where $dT/dt >$ the predetermined value. At the time the microwave generator is shut off, the moisture content in the fabric is down to about 3–4 percent.

The invention is particularly suitable for use in consumer laundry appliances, but it can also be utilized in commercial and industrial fabric drying equipment.

It is apparent from the foregoing that a new and improved end of cycle detector and method for a microwave clothes dryer have been provided. While only certain presently preferred embodiments have been described in detail, as will be apparent to those familiar with the art, certain changes and modifications can be made without departing from the scope of the invention as defined by the following claims.

What is claimed is:

1. In an end of cycle detector for a microwave clothes dryer: means for monitoring the temperature of fabric in the dryer, means for detecting an increase in the fabric temperature which occurs when substantially all moisture has been removed from the fabric, and means responsive to the increase in fabric temperature for controlling operation of the dryer.

2. The end of cycle detector of claim 1 wherein the means for controlling operation of the dryer includes means for turning the dryer off in response to the increase in fabric temperature.

3. In a method of detecting the end of a drying cycle in a microwave clothes dryer, the steps of: monitoring the temperature of fabric in the dryer, detecting an increase in the fabric temperature which occurs when substantially all moisture has been removed from the fabric, and controlling operation of the dryer in response to the increase in fabric temperature.

4. The method of claim 3 wherein the dryer is turned off in response to the increase in fabric temperature.

5. In a microwave clothes dryer: a drying chamber, means for tumbling fabric to be dried in the chamber, means for introducing microwave energy into the chamber during a drying cycle to vaporize moisture in the fabric, means for monitoring the temperature of the fabric, means for detecting an increase in the fabric temperature which occurs when substantially all moisture has been removed from the fabric, and means responsive to the increase in fabric temperature for terminating the drying cycle.

6. In a method of drying fabric in a microwave clothes dryer, the steps of: tumbling the fabric in the drying chamber of the microwave clothes dryer, introducing microwave energy into the chamber during a drying cycle to vaporize moisture in the fabric, monitoring the temperature of the fabric, detecting an increase in the fabric temperature which occurs when substantially all moisture has been removed from the fabric, and terminating the drying cycle in response to the increase in fabric temperature.

7. The end of cycle detector of claim 1 wherein the means for controlling operation of the dryer includes means for turning the dryer off a preset time after the increase in fabric temperature is detected.

8. The method of claim 3 wherein the dryer is turned off a preset time after the increase in fabric temperature is detected.

9. The microwave clothes dryer of claim 5 wherein the means for terminating the drying cycle includes means for terminating the drying cycle a preset time after the rise in fabric temperature is detected.

10. The method of claim 6 wherein the drying cycle is terminated a preset time after the increase in fabric temperature is detected.

11. In a method of drying fabric in a microwave clothes dryer, the steps of: tumbling the fabric in the drying chamber of the microwave clothes dryer, introducing microwave energy into the chamber during a drying cycle to vaporize moisture in the fabric, monitoring the temperature of the fabric, detecting a sharp rise in the fabric temperature, and terminating the drying cycle a preset time after the sharp rise in fabric temperature is detected.

* * * * *